US009486038B1

(12) United States Patent
Eberstadt, III

(10) Patent No.: US 9,486,038 B1
(45) Date of Patent: Nov. 8, 2016

(54) APPARATUS THAT FITS INTO THE EYELETS OF LACE UP FOOTWEAR AND PERMITS A CLOSURE MEANS ALTERNATIVE TO LACES

(71) Applicant: Rudolph Eberstadt, III, Norwalk, CT (US)

(72) Inventor: Rudolph Eberstadt, III, Norwalk, CT (US)

( * ) Notice: Subject to any disclaimer, the term of this patent is extended or adjusted under 35 U.S.C. 154(b) by 411 days.

(21) Appl. No.: 13/745,879

(22) Filed: Jan. 21, 2013

(51) Int. Cl.
*A43C 3/00* (2006.01)
*A43C 5/00* (2006.01)
*A43C 1/02* (2006.01)

(52) U.S. Cl.
CPC . *A43C 5/00* (2013.01); *A43C 1/02* (2013.01); *A43C 3/00* (2013.01)

(58) Field of Classification Search
CPC ..... A43C 1/02; A43C 1/04; A43C 3/00; A43C 3/02
USPC ..... 36/50.1, 136; 24/712, 713.3–713.6, 24/714.1, 714.5, 715.2
See application file for complete search history.

(56) References Cited

U.S. PATENT DOCUMENTS 414,684 A * 11/1889 Cummings ..... 29/12
434,959 A * 8/1890 Smidt ..... 24/714.3
494,825 A * 4/1893 Spicer ..... 24/575.1
565,131 A * 8/1896 Bliss ..... 24/713.5
699,569 A * 5/1902 Renfrew ..... 24/713.9
715,148 A * 12/1902 Reenstierna ..... 24/713.7
1,224,390 A * 5/1917 Lipinski ..... 24/713.3
1,466,673 A * 9/1923 Solomon et al. ..... 24/713.3
2,913,793 A * 11/1959 Tallarico ..... 24/713.9
5,848,457 A * 12/1998 Silagy ..... 24/712.1
6,502,329 B1 * 1/2003 Silagy ..... 36/50.1
2002/0194748 A1 * 12/2002 Jackson et al. ..... 36/51
2005/0126041 A1 * 6/2005 Gonzalez Palacio ..... 36/50.1
2008/0141560 A1 * 6/2008 Lewis ..... 36/50.1

* cited by examiner

*Primary Examiner* — Marie Bays
(74) *Attorney, Agent, or Firm* — Gordon & Jacobson, PC

(57) ABSTRACT

A substantially cylindrical member having a stepped diameter and a lower portion dimensioned to fit snugly into the lace eyelets of a lace-up shoe (footwear, including a sneaker, e.g.). The upper end includes a circumferential groove which is adapted to receive an elastic member such as a rubber band, O-ring, or the like. The lower may be bifurcated to facilitate insertion into the shoe eyelets. As illustrated, the lower end is double bifurcated at right angles. According to one embodiment, the invention is sold as a kit which includes enough members to fill all of the eyelets of a shoe and enough elastic members to match. According to other embodiments: a pair of shoes are sold with the invention pre-installed; the invention is permanently installed; the cylindrical members and the elastic members are provided in different colors; the tops are adorned with three dimensional decorations.

10 Claims, 9 Drawing Sheets

APPARATUS THAT FITS INTO THE EYELETS OF LACE UP FOOTWEAR AND PERMITS A CLOSURE MEANS ALTERNATIVE TO LACES

BACKGROUND OF THE INVENTION

1. Field of the Invention

This invention relates broadly to footwear. More particularly, this invention relates to apparatus attachable to the eyelets of lace up footwear and which permits a closure means alternative to laces.

2. State of the Art

U.S. Pat. No. 963,799 issued Jul. 12, 1910 to McDade for Fastening for Shoes, Corsets, &c discloses a hook that attaches to the eyelets of a shoe and which is connected to another hook by an elastic member. "the hook 3 is passed through an eyelet and brought firmly against its side, the hook 7 is then passed through this eyelet and its ends 8 are pinched together and brought down until they can be passed over 80 the ends 6 of the frame 4 which hold them and the hook 7 in this position until they are manually released."

U.S. Pat. No. 2,245,950 issued Jun. 17, 1941 to Williams for Shoe Fastener discloses "[t]he combination with a shoe, and keepers connected to the shoe at opposite sides respectively of the front thereof, of a fastener including a resilient band having a terminal tab, spaced plates attached to the band, a hook on each plate, said hooks being extended toward each other and positioned for engagement with the respective keepers, and a resilient tongue integral with one of the hooks for engagement with the keeper of said hook to hold the hook and keeper against separation."

U.S. Pat. No. 6,701,589 issued Mar. 9, 2004 to Kliewer for Shoe Fastening Devices and Methods of Use discloses "a shoe fastening device and methods for its use. The device comprises a double ended clip hook with a flattened, contoured c-shape hook at both its two ends. An elastomeric fastener is grasped at one hook end of the double ended clip hook which is inserted manually into one of a pair of eyelets over the tongue of the shoe and then the elastic is stretched to the second eyelet of the pair to be securely held by the other hook end. Identifying tags or decorations can be a part of the fastener to be used with children's shoes or to identify an elderly or infirm wearer. Shoes that may utilize the device of this invention include oxfords, walking shoes, sneakers, athletic shoes, and boots designed for lacing.

U.S. Pat. No. 7,506,420 issued Mar. 24, 2009 to Frydlewski for: Footwear and Clothes Fastening and Transforming System discloses "[a] combined fastening device to be used in elements designed for lacing, such as pieces of clothing, footwear, and similar items. The device includes a main frame substantially filiform with a first end, to which a clamping part is assembled and fixed, and a second ring-shaped end, which is fastened to the clamping part. The device provides users with the possibility to customize and decorate their footwear, and at the same time prevents the accidents and problems caused by conventional shoelaces, preserving the users' physical wellbeing."

SUMMARY OF THE INVENTION

According to one embodiment, the invention includes a substantially cylindrical member having a stepped diameter. The lower portion of the member is dimensioned to fit snugly into the lace eyelets of a lace-up shoe (footwear, including a sneaker, e.g.). The upper end of the member included a circumferential groove which is adapted to receive an elastic member such as a rubber band, O-ring, or the like. As used herein, the term "eyelet" shall mean any opening or hole designed to allow passage of a shoe lace. It need not be reinforced with an interior ring of any sort.

According to a second embodiment, the lower end is bifurcated to facilitate insertion into the shoe eyelets. As illustrated, the lower end is double bifurcated at right angles.

According to one embodiment of the invention, it is sold as a kit which includes enough members to fill all of the eyelets of a shoe and enough elastic members to match.

According to another embodiment, a pair of shoes are sold with the invention pre-installed. In an alternate to this embodiment, the invention is permanently installed.

According to another embodiment, the cylindrical members and the elastic members are provided in different colors.

According to still another embodiment, the tops are adorned with three dimensional decorations.

Additional objects and advantages of the invention will become apparent to those skilled in the art upon reference to the detailed description taken in conjunction with the provided figures.

DETAILED DESCRIPTION

Figure 1:
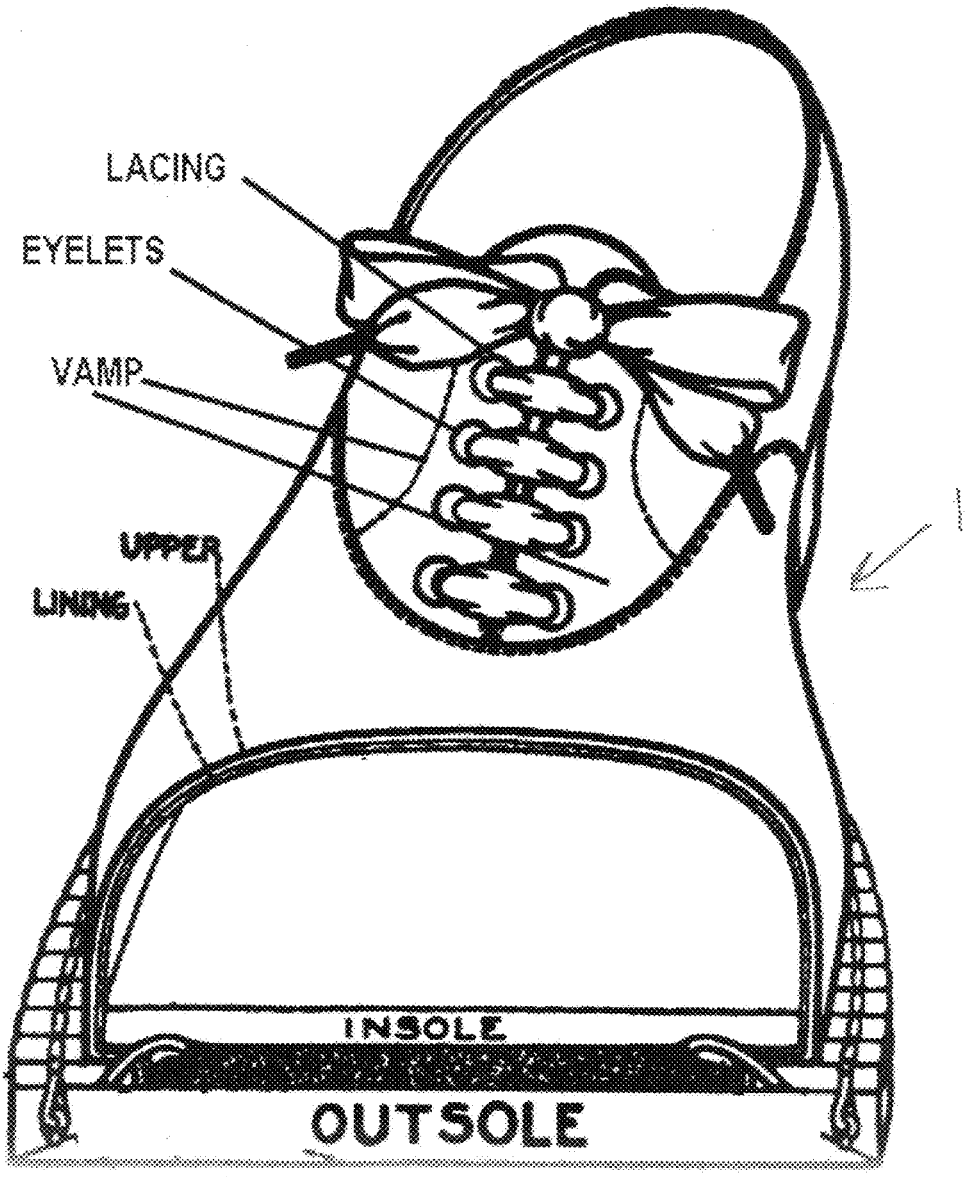
FIG. 1 PRIOR ART
FIG. 1 is a prior art cut away diagram of the parts of an item of footwear that is lace-up.

Turning now to FIG. 1, a prior art lace-up shoe (e.g. a sneaker or tennis shoe) comprises a number of parts which are labelled in FIG. 1. The present invention is concerned with the vamps (medial and lateral) which define eyelets through which lacing is treaded and tied to hold the shoe onto the foot.

Figure 2:
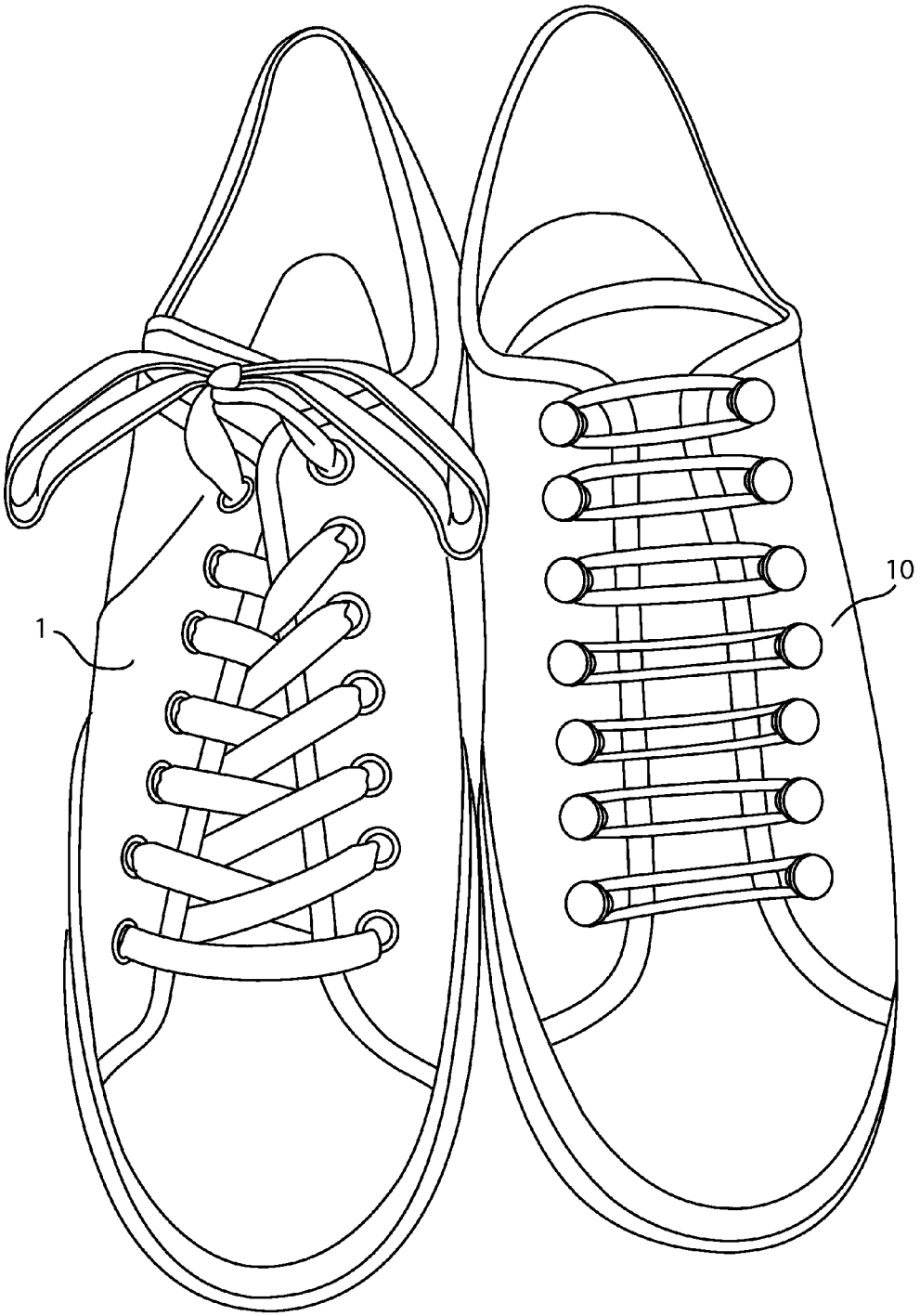
FIG. 2 is a perspective illustration of a prior art lace-up shoe on the left and the same shoe retro-fitted with the invention on the right.
Figure 4:
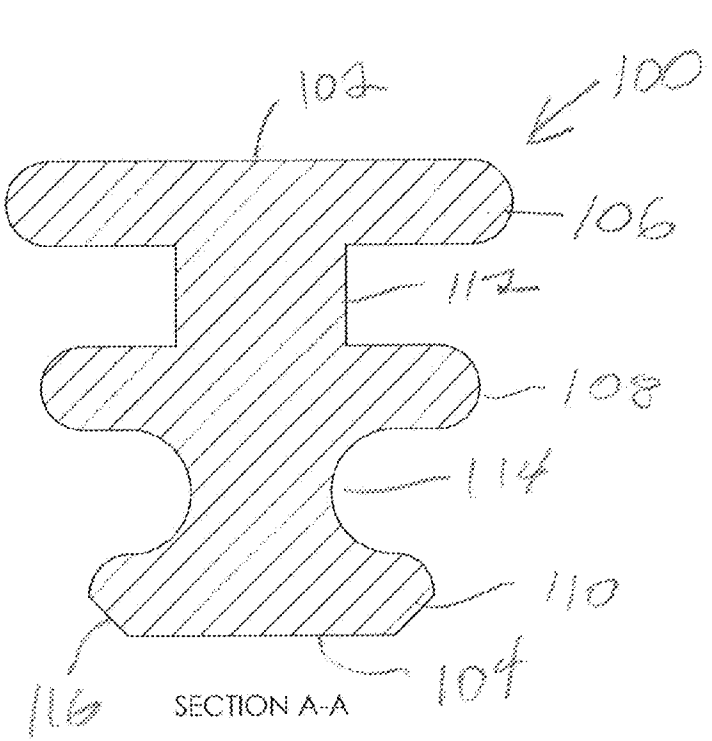
FIG. 4 is a cross sectional view taken along line A-A in FIG. 3.
Figure 3:
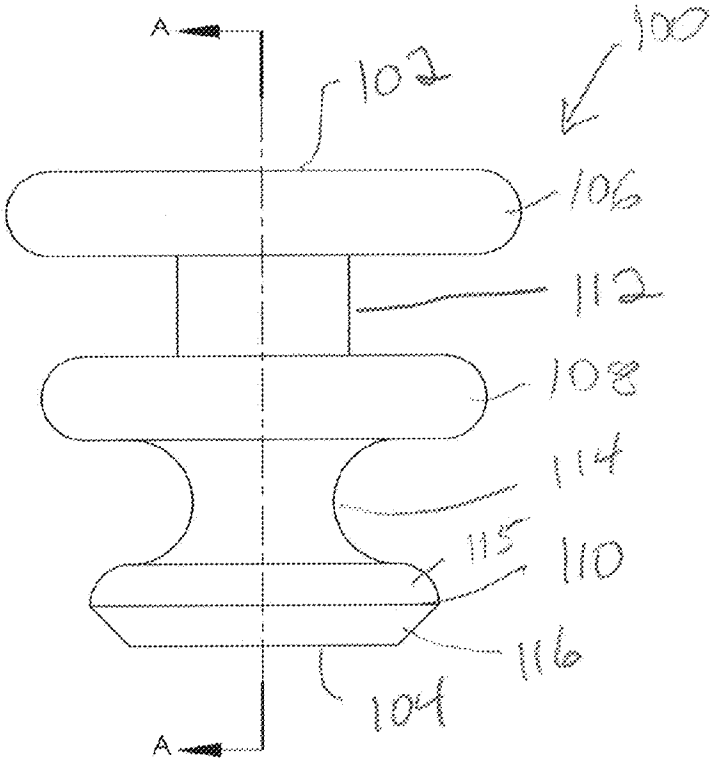
FIG. 3 is a side elevation view of a first embodiment of the invention.
Figure 6:
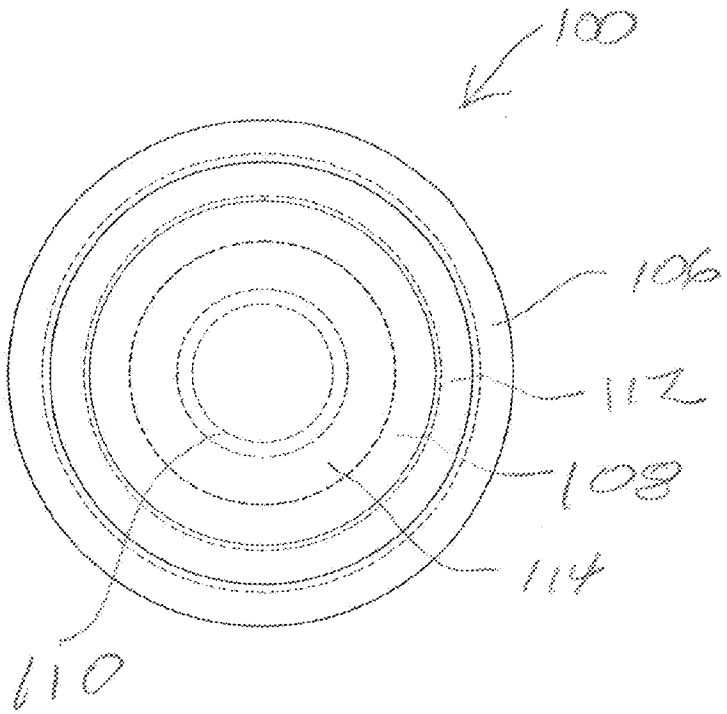
FIG. 6 is a top plan view of the first embodiment showing the stepped diameters in phantom lines.
Figure 5:
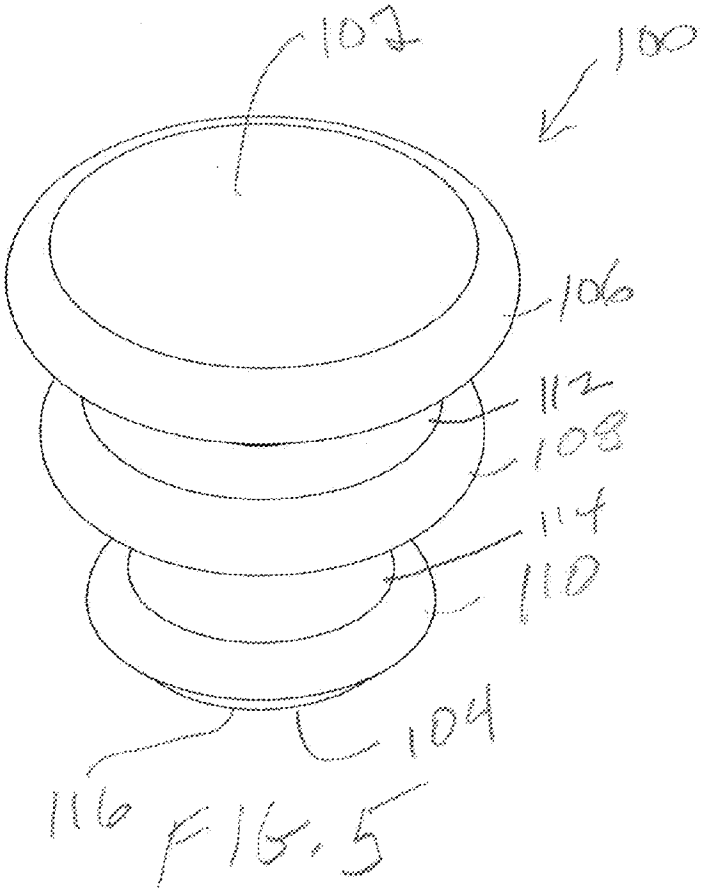
FIG. 5 is a perspective view of the first embodiment.
Figure 8:
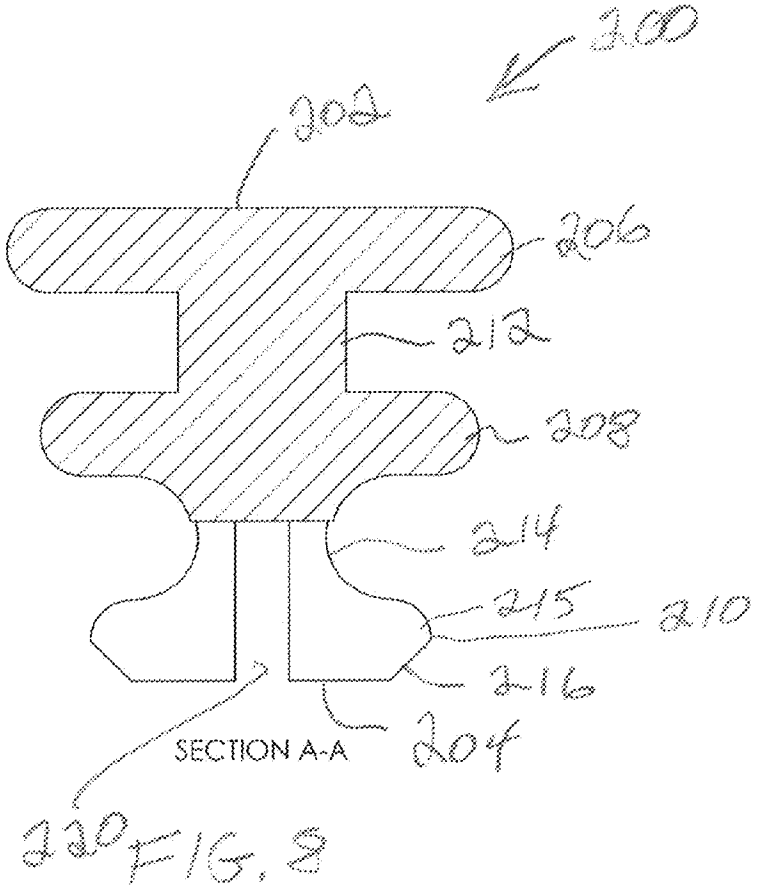
FIG. 8 is a cross sectional view taken along line A-A in FIG. 7.

FIG. 2 illustrates a comparison of the prior art lace up shoe 1 and the same shoe with the invention installed and labeled 10.

FIGS. 3-6 illustrate a first embodiment 100 retrofittable to an existing item of footwear having vamps that define eyelets. The invention 100 is a generally cylindrical member (stud) having a top 102 and a bottom 104 with a stepped diameter therebetween which includes relatively large diameter portions 106, 108, 110 separated by relatively small diameter portions 112 and 114. The large diameter portions 106, 108, 110 have generally decreasing diameters from top to bottom as seen best in FIGS. 3 and 4. That is, the portion 106 has a larger diameter than the portion 108 which has a larger diameter than the portion 110. Smaller diameter portion 112 is a generally regular cylinder while the smaller diameter portion 114 is a narrow waist cylinder. The narrow waist cylinder engages the interior periphery of the eyelet, the interior periphery being generally rounded. Portions 106 and 108 have rounded peripheries. The portion 110 has an upper rounded part 115 and a lower chamfered (frustroconical) part 116.

Figure 11:
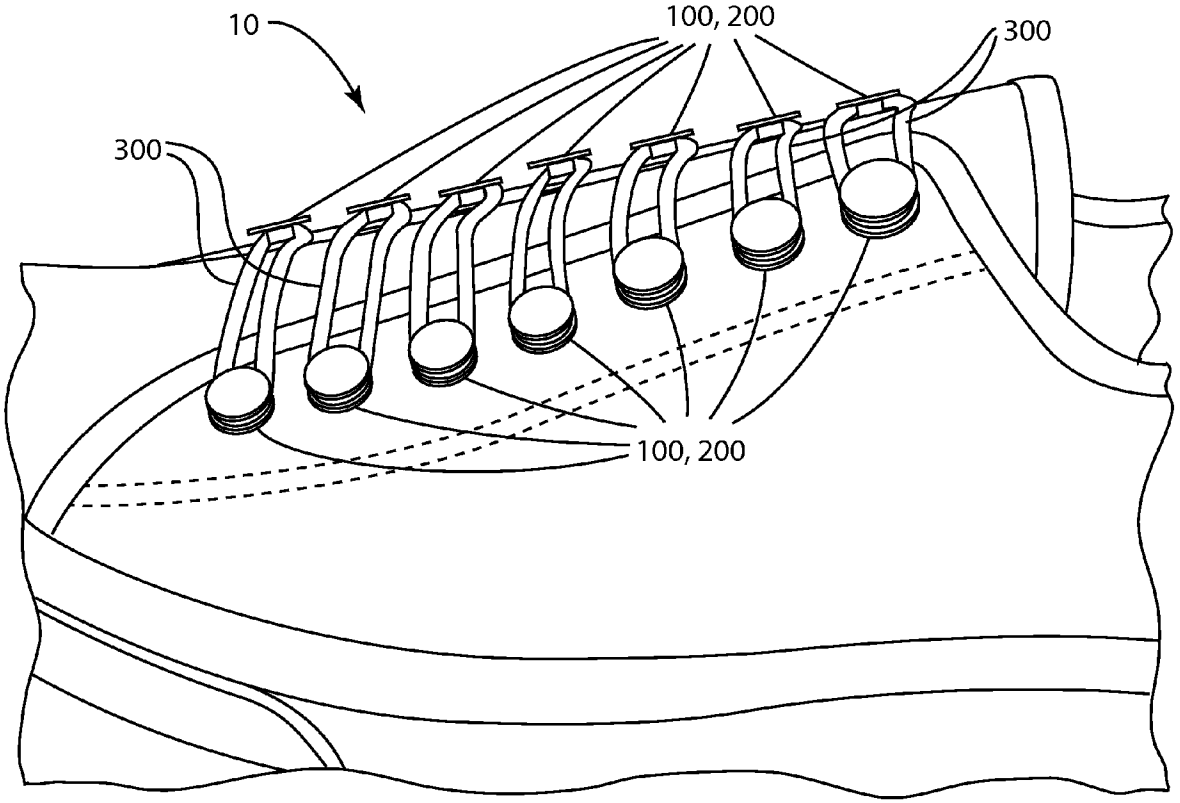
FIG. 11 is a broken perspective view of a lace-up shoe illustrating the invention in place of laces.

The apparatus 100 is made of a generally resilient material so that it can be inserted into the eyelet of lace-up shoe as shown in FIGS. 2 and 11. The chamfered portion 116 allows the apparatus to be more easily inserted and clearly the dimensions of portions 110 and 114 are such that the apparatus will enter the eyelet and the dimension of portion 108 is such that it will prevent the apparatus from passing completely through the eyelet. The dimensions of portions 106, 108, 112 are such that an elastic device such as a rubber band or an O-ring (300 in FIG. 11) can be securely engaged between portions 106 and 108 as shown in FIGS. 2 and 11.

FIGS. 7-10 illustrate a second embodiment 200 of the invention where similar reference numerals (increased by 100) represent similar features.

The apparatus 200 is a generally cylindrical member having having a top 202 and a bottom 204 with a stepped diameter therebetween which includes relatively large diameter portions 206, 208, 210 separated by relatively small diameter portions 212 and 214. The large diameter portions 206, 208, 210 have generally decreasing diameters from top to bottom as seen best in FIGS. 7 and 8. That is, the portion 206 has a larger diameter than the portion 208 which has a larger diameter than the portion 210. Smaller diameter portion 212 is a generally regular cylinder while the smaller diameter portion 214 is a narrow waist cylinder. The narrow waist cylinder engages the interior periphery of the eyelet, the interior periphery being generally rounded. Portions 206 and 208 have rounded peripheries. The portion 210 has an upper rounded part 215 and a lower chamfered (frustroconical) part 216.

According to the second embodiment, the lower portions 204, 210, 214 are bifurcated at 220 (FIGS. 7 and 8) forming a space between bifurcated portions. Those skilled in the art will appreciate that this space further enables the apparatus to easily enter the eyelet of lace-up footwear. According to the preferred second embodiment, a second bifurcation 222 is provided (FIGS. 9 and 10) at right angles to the first bifurcation 220. However, those skilled in the art will appreciate that right angles are not essential and additional bifurcations could be included.

The apparatus 200 is made of a generally resilient material so that it can be inserted into the eyelet of lace-up shoe as shown in FIGS. 2 and 11. The chamfered portion 216 allows the apparatus to be more easily inserted and clearly the dimensions of portions 210 and 214 are such that the apparatus will enter the eyelet and the dimension of portion 208 is such that it will prevent the apparatus from passing completely through the eyelet. The dimensions of portions 206, 208, 212 are such that an elastic device such as a rubber band or an O-ring can be securely engaged between portions 206 and 208 as shown in FIGS. 2 and 11.

Figure 7:
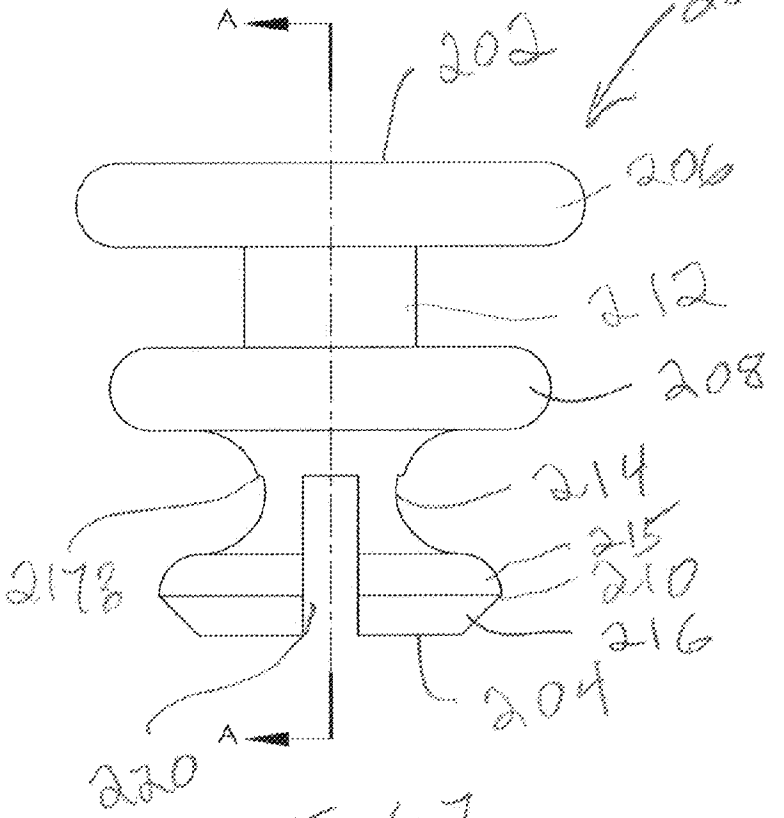
FIG. 7 is a side elevation view of a second embodiment of the invention.
Figure 7A:
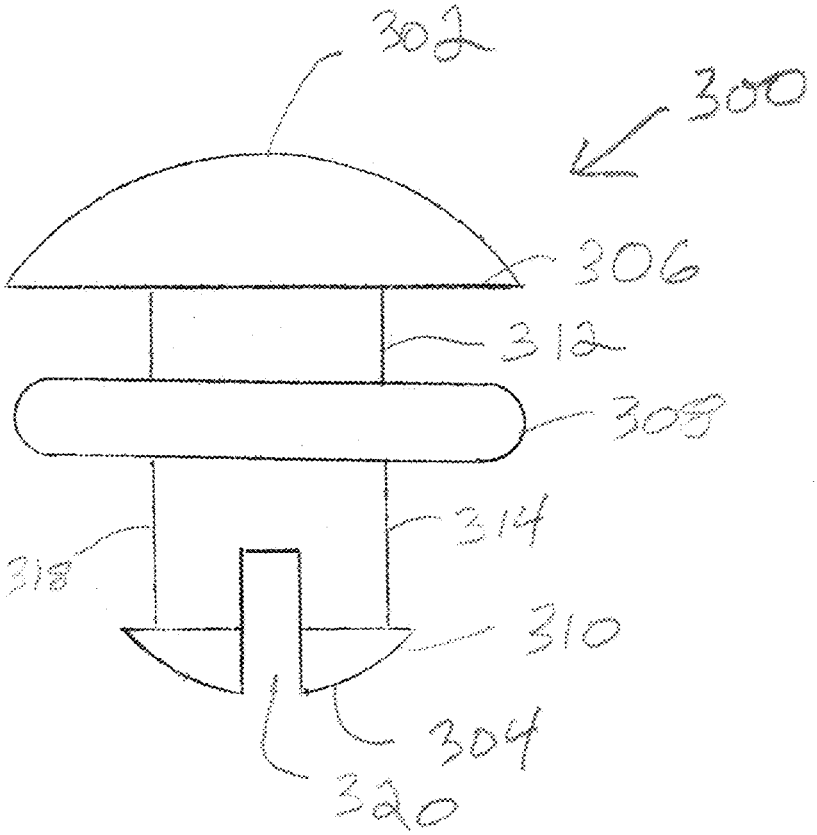
FIG. 7A is an alternate embodiment of he invention shown in FIG. 7.
Figure 10:
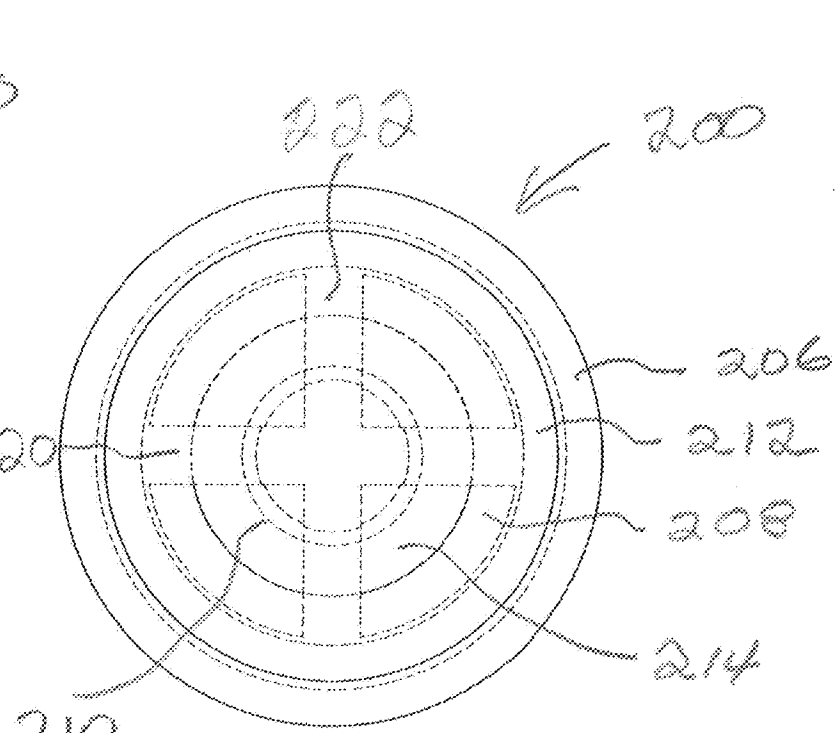
FIG. 10 is a top plan view of the second embodiment showing the stepped diameters in phantom lines.
Figure 9:
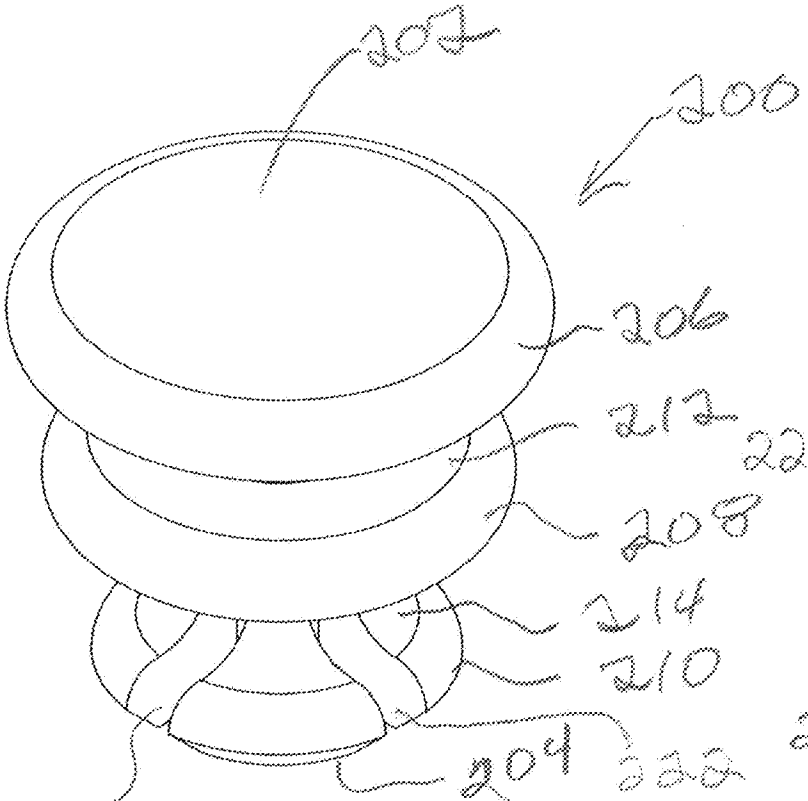
FIG. 9 is a perspective view of the second embodiment.

The apparatus 300 shown in FIG. 7A s a generally cylindrical member having a top 302 and a bottom 304 with a stepped diameter therebetween which includes relatively large diameter portions 306, 308, 310 separated by relatively small diameter portions 312 and 314. The large diameter portions 306, 308 have substantially the same diameter whereas the portion 310 has a generally smaller diameter. Smaller diameter portions 312, 314 are generally regular cylinders, i.e. the waist 318 of the cylinder 314 is not reduced in diameter. The cylinder 314 engages the interior periphery of the eyelet. Portions 302 and 304 have generally convex outer surfaces being spherical sections or the like. The peripheries 306, 310 present relatively pointed edges.

According to the second embodiment and its alternate, the lower portions 204, 210, 214 (304, 310, 314) are bifurcated at 220 (320) (FIGS. 7, 7A, and 8) forming a space between bifurcated portions. Those skilled in the art will appreciate that this space further enables the apparatus to easily enter the eyelet of lace-up footwear. According to the preferred second embodiment, a second bifurcation 222 is provided (FIGS. 9 and 10) at right angles to the first bifurcation 220. However, those skilled in the art will appreciate that right angles are not essential and additional bifurcations could be included.

The apparatus 200 (300) is made of a generally resilient material so that it can be inserted into the eyelet of lace-up shoe.

FIG. 11 shows several iterations (fourteen) of an embodiment of the invention (100, 200) inserted into the eyelets of a sneaker and coupled to each other by seven elastic members 300. The studs 100, 200 may be different colors as may be the elastic members 300. For example, the studs and elastic members may be arranged as matching trios, e.g. studs and one elastic member having one color followed by a matching trio of a different color. In one example, the colors could be arranged either from to bottom or bottom to top: red, orange, yellow, green, blue, indigo, violet, epitomizing the spectrum of visible light. Clearly other combinations such as, e.g. school colors, could be used.

Figure 12:
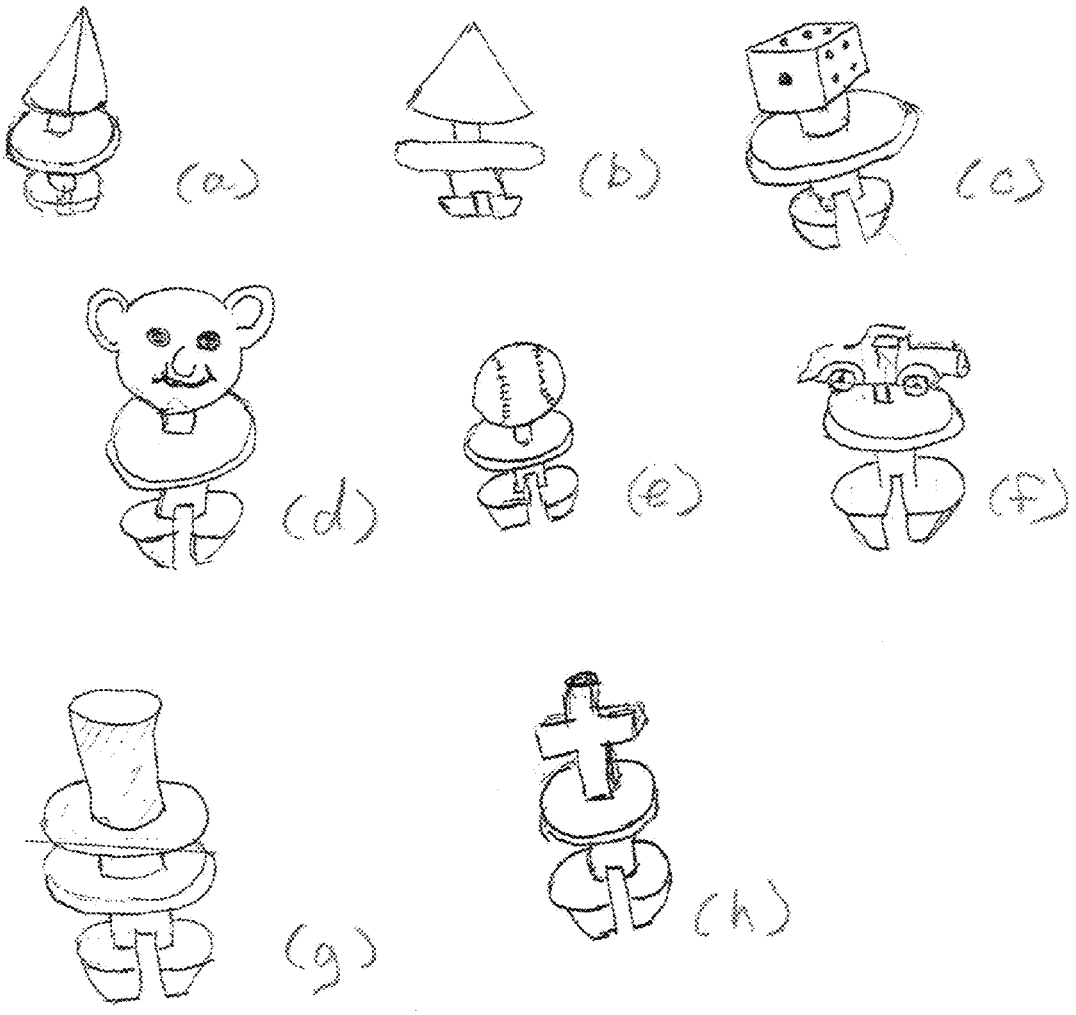
FIG. 12 is a collection of perspective views of the invention with decorative tops.

In addition to colors, the studs can be made with additional ornamentation on their tops. FIG. 12 shows eight examples: a pyramid (a), a cone (b), a die (c), a teddy bear head (d), a baseball (e) (though not shown, other sporting balls such as a football or basketball could be used and this could work well with the use of school colors), an antique car (f), a top hat (g), a cross (h). Other interesting decorations could be provided and coordinated with colors if appropriate.

The apparatus may be manufactured by 3-D printing, injection molding, or cutting on a lathe. Injection molding is the presently preferred method.

There have been described and illustrated herein several embodiments of an APPARATUS THAT FITS INTO THE EYELETS OF LACE UP FOOTWEAR AND PERMITS A CLOSURE MEANS ALTERNATIVE TO LACES. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as claimed.

What is claimed is:

1. A kit for use with lace up item of footwear having a plurality of lace eyelets, said kit comprising:

a plurality of parts, each part being a substantially cylindrical member, said cylindrical member having a stepped diameter, each member having a lower portion for removably fitting snugly into a lace eyelet of the lace-up item of footwear, each member having an upper end including a circumferential groove which is adapted to receive an endless elastic member, and a plurality of endless elastic members, each adapted to removably fit into said circumferential grooves, said plurality of elastic members numbering at least half in number as said number of said plurality of parts, each endless elastic member adapted to join two parts.

2. The kit according to claim 1, wherein:

said lower portion is bifurcated to facilitate insertion into and removal from a lace eyelet.

3. The kit according to claim 2, wherein:

said lower portion is double bifurcated at right angles.

4. The kit according to claim 1, wherein:

at least two of said parts are different colors.

5. The kit according to claim 1, wherein:

at least one of said parts has an ornamentation on its top end.

6. The kit according to claim 1, wherein:

said ornamentation is three dimensional.

7. An article of footwear, comprising:

a plurality of parts extending outward from an upper on the article of footwear, each part being a substantially cylindrical member, said cylindrical member having a stepped diameter, each member having an upper end including a circumferential groove which is adapted to receive an endless elastic member, and a plurality of endless elastic members, each adapted to removably fit into said circumferential grooves, said plurality of endless elastic members numbering at least half in number as said number of said plurality of parts, each endless elastic member adapted to join two parts.

8. The article of footwear according to claim 7, wherein:

at least two of said parts are different colors.

9. The article of footwear according to claim 7, wherein:

at least one of said parts has an ornamentation on its top end.

10. The article of footwear according to claim 9, wherein:

said ornamentation is three dimensional.

* * * * *